US005392746A

United States Patent [19]

Pontoppidan

[11] Patent Number: 5,392,746

[45] Date of Patent: Feb. 28, 1995

[54] ELECTRONICALLY CONTROLLED FUEL INJECTION DEVICE WITH AIR ASSISTANCE

[75] Inventor: Michael Pontoppidan, Rueil-Malmaison, France

[73] Assignee: Solex, Nanterre, France

[21] Appl. No.: 152,497

[22] Filed: Nov. 16, 1993

[30] Foreign Application Priority Data

Nov. 16, 1992 [FR] France ..... 92 13750

[51] Int. Cl.[6] ..... F02M 51/00

[52] U.S. Cl. ..... 123/327; 123/491; 123/179.18

[58] Field of Search ..... 123/327, 491, 493, 531, 123/585, 588, 179.18

[56] References Cited

U.S. PATENT DOCUMENTS

| | | | |
|---|---|---|---|
| 4,519,354 | 5/1985 | Katoh et al. | 123/472 |
| 4,519,370 | 5/1985 | Iwata | 123/432 |
| 4,700,679 | 10/1987 | Otobe et al. | 123/327 |
| 4,732,122 | 3/1988 | Scarnera et al. | 123/491 |
| 4,989,563 | 2/1991 | Fukutomi et al. | 123/327 |
| 5,035,358 | 7/1991 | Katsuno et al. | 239/403 |
| 5,205,120 | 4/1993 | Obländer | 123/585 |
| 5,224,458 | 7/1993 | Okada et al. | 123/531 |

FOREIGN PATENT DOCUMENTS

WO92/14053 7/1992 WIPO .

OTHER PUBLICATIONS

Patent Abstracts of Japan-vol. 6, No. 263 (M-181) Dec. 22, 1982 & JP-A-57 157 058 (Toyoto Jidosha Kogyo KK) Sep. 28, 1982-Abstract.

Patent Abstracts of Japan-vol. 8, No. 240 (M-336) Nov. 6, 1984 & JP-A-59 119 053 (Nippon Jidosha Buhin Sogo Kenkyusho KK) Jul. 10, 1984-Abstract.

*Primary Examiner*—Andrew M. Dolinar
*Assistant Examiner*—Weilun Lo
*Attorney, Agent, or Firm*—Larson and Taylor

[57] ABSTRACT

A fuel injection device comprises electrically controlled fuel injectors, each opening into an air induction passage upstream of a respective intake valve of a combustion chamber. Each injector has an air-fuel mixture chamber. A throttle valve in the induction passage is constructed to close it when in a minimum opening position. An air line connects the induction passage to the mixture chambers and has an additional air electrically controlled valve. A supplemental electrically controlled valve is branched out of the line and opens into the induction passage downstream of the throttle valve. An electronic unit controls the injectors and the supplementary valve and opens the supplemental valve during cold start of the engine at low temperature and during operation of the engine as a brake at normal temperature, high speed and with the throttle valve closed.

6 Claims, 2 Drawing Sheets

FIG. 2.
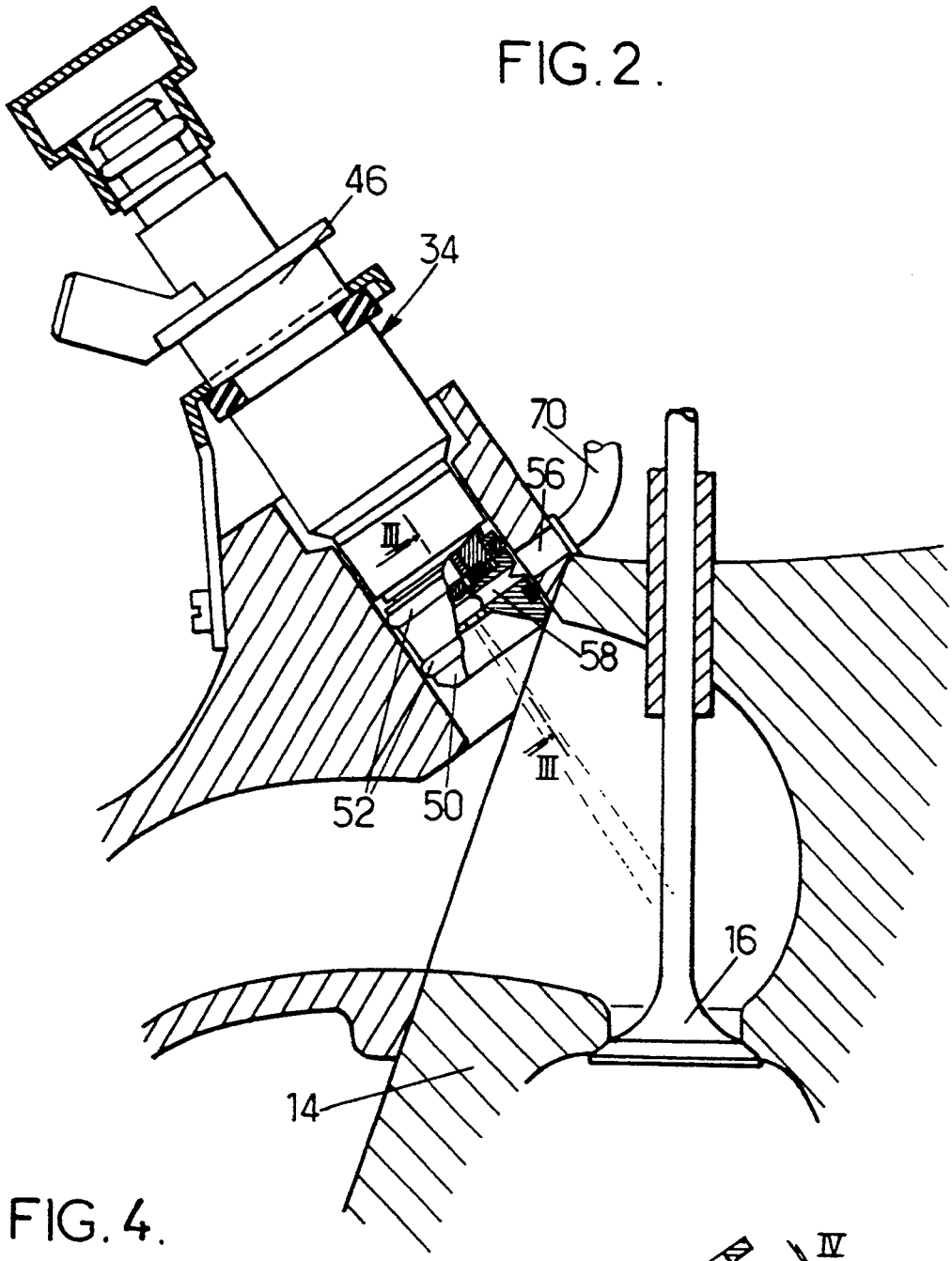
FIG. 4.
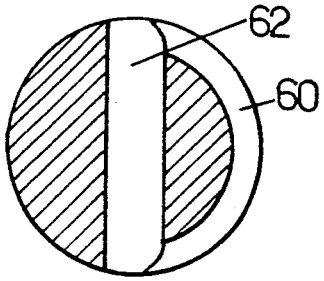
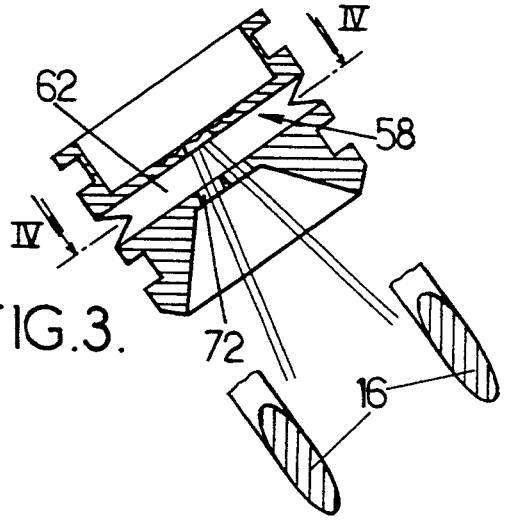
FIG. 3.

ELECTRONICALLY CONTROLLED FUEL INJECTION DEVICE WITH AIR ASSISTANCE

BACKGROUND OF THE INVENTION

The invention relates to electronically controlled fuel injection devices for internal combustion engine, comprising a plurality of electrically controlled injectors.

The invention is particularly suitable for use in "multipoint" fuel injection devices, wherein each combustion chamber of the engine is provided with an injector which opens into the induction passage in the immediate vicinity of the respective inlet valve.

The invention more particularly relates to fuel injection devices of the type comprising a plurality of electrically controlled injectors, an electronic unit controlling the injectors responsive to operating parameters of the engine, and a throttle valve assembly having an operator controlled valve in an air induction passage feeding the combustion chambers, each injector having an injector body formed with means for securing it in a recess which opens into the induction passage and a nose formed with at least one fuel outlet passage, defining a mixture chamber connected to an atomization air inlet.

Injection devices are already known (European No. 0,357,498) having an injector which has a chamber provided with an air inlet. As a rule, the air flow to the injectors is drawn from the air inlet of the fuel injection device. Air admission improves atomization of the fuel delivered by the injector.

In a modification (European No. 0,409,170) the flow of additional air drawn from a location upstream of the throttle valve and delivered to each injector is controlled by a three way idling valve which also operates as a regulator for idling operation.

Last, Japanese No. 57,157,058 discloses a fuel delivery device having a sub-section pipe which is branched for delivering air necessary for atomization of fuel in each of the injectors, namely injectors for normal operation and one auxiliary injector for cold start. The branch toward the cold start injector is only open when that injector is used.

Some fuel injection devices have a throttle valve apt to close the induction passage almost completely. The flow of additional air in a line having an inlet located upwardly of the butterfly valve is adjustable by an electrically controlled valve. That air valve is controlled by the electronic unit, responsive to operation parameters of the engine, such as the degree of opening of the throttle valve and the speed of the engine for regulation of the idling speed, the water temperature and the running speed of the engine for cold start. The electronic unit renders cold start of the engine easier; it regulates the idling speed and improves transition when the engine acts as a brake.

SUMMARY OF THE INVENTION

An object of the invention is to provide an improved fuel injection device. It is a more specific object to improve atomization when the engine operates under conditions other than full load, particularly during starting at very low temperature (cold operation), and deceleration at high speed and with a low load. It is another object to obtain such results without a "start" injector additional to those for injection of fuel immediately upstream of the combustion chambers.

For that purpose, additional air is brought to the injectors at an adjusted flow rate. Consequently, there is provided an injection device comprising a line for delivering air which traversed an electrically controlled valve to a distributor for feeding air to the mixture chambers of all injectors and to a supplementary electro-controlled valve which opens into the induction passage downstream of the butterfly valve. As indicated above, the device has no cold start injector.

The supplementary electro-controlled valve (which will be referred in the following as the supplementary valve) will be typically also controlled by the electronic unit, often times for being either in a fully open or in a fully closed position. The supplementary valve may typically be open during very low temperature cold start of the engine, which requires an airflow rate much more important than the flow rate which may pass through the air assistance network comprising the distributor, channels for bringing air to injectors and the mixture chambers.

On vehicles having a catalytic exhaust converter, the supplementary valve will also be open when the engine is at its normal operating temperature, runs at a high speed and operates as a brake, with the throttle valve closed. Then a high flow rate, frequently of about 60–70 kg per hour for a vehicle of medium engine capacity, is required to avoid damaging the catalyst. The airflow is much higher than that which may pass through the atomization restriction which is typically provided in each injector.

More generally, the supplementary valve will typically be sized for the maximum flow rate through it to be comprised between 2.5 and 4 times the maximum flow rate (which is limited by a sonic throat effect) which can reach the mixture chambers of the injectors. In a four-cylinder engine, the maximum flow rate of the supplementary valve will typically be three times the maximum flow rate of the four injectors.

Incidentally, the series relation of the additional air valve and supplementary valve on the path from upstream to downstream of the throttle valve removes problems which would exist with two distinct circuits, one feeding the injectors and provided with the additional air valve, the other by-passing the throttle valve and having the supplementary valve. In the latter case, the supplementary valve would have to be designed for being substantially free of leaks when closed for not detrimontally affecting operation of the engine when idling or under a light load.

Another object of the invention is to provide a device which alleviates problems of "surge" and accumulation of fuel in the mixture chamber of the injectors, when operating with a pressure gradient between the intake manifold and the mixture chamber which is lower than the sonic value. For that purpose, there is provided an injection device of the above-defined type, wherein the mixture chamber comprises a half-ring receiving air in its central portion and a diametral passage which is traversed by the fuel jet or jets.

If there are several jets, the injector will typically be arranged for the jets to be narrow and with a low angle, at least when there is no atomization air assistance. In a particular embodiment, the injector has two divergent jets, located in a mid-plane of the diametral passage. Where there are a plurality of jets, the jets are each contained in a plane which includes the axis of the respective injector valve.

The invention will be better understood from the following description of a particular embodiment of the invention, given by way of example.

BRIEF DESCRIPTION OF THE DRAWINGS

FIG. 2 is a schematic representation of an air assisted injector suitable for use in the device of FIG. 1;

FIG. 3 is a cross-section along line III—III of FIG. 2, showing the nose of an injector having two jets; and FIG. 4 is a cross-section along line IV—IV of FIG. 3.

DETAILED DESCRIPTION OF THE INVENTION

Figure 1:
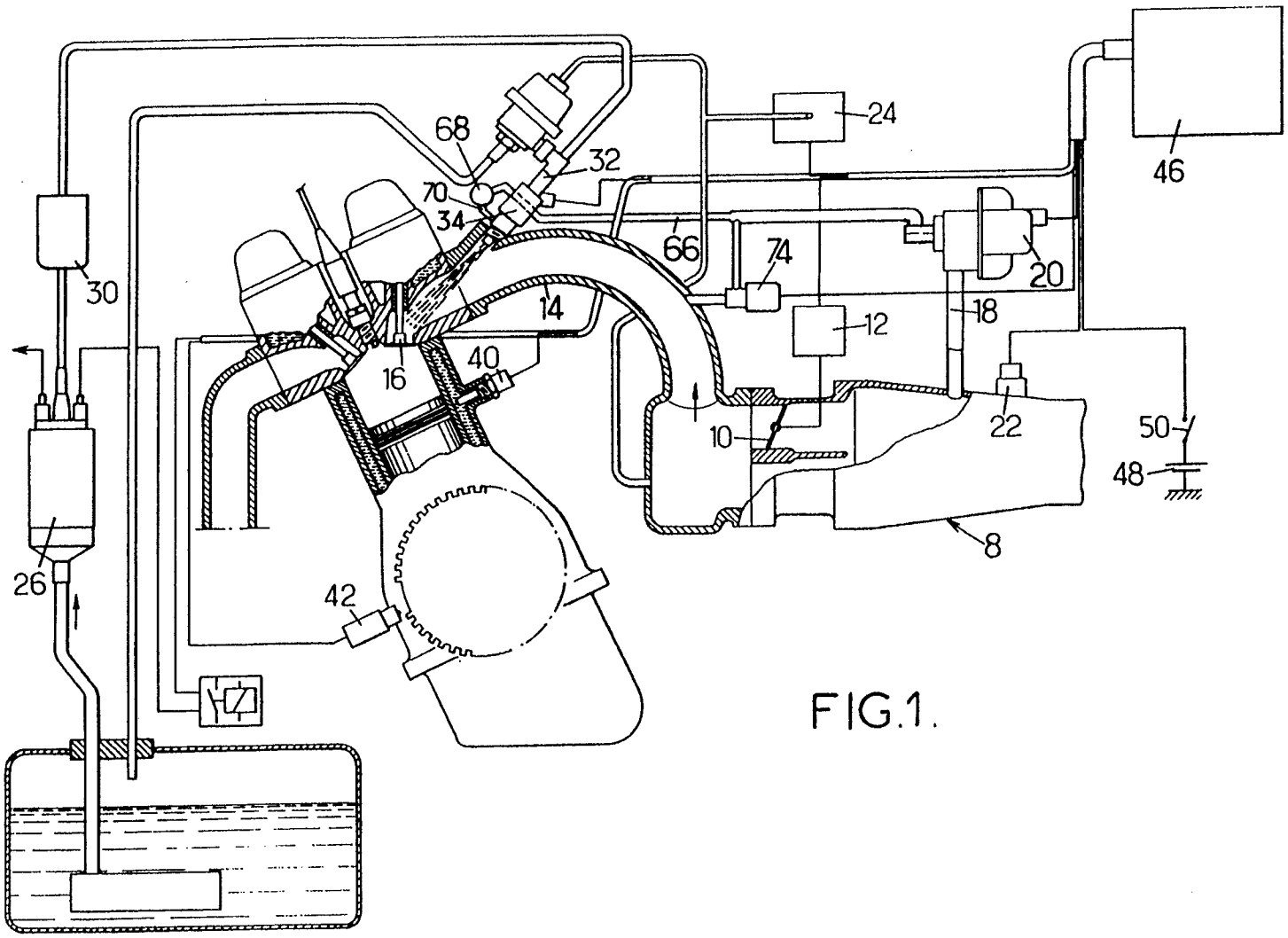
FIG. 1 is a schematic representation of the general arrangement of a "multipoint" injection device suitable for implementing the invention.

Referring to FIG. 1, the device has a general construction similar to that described in French patent No. 89 04287, to which reference may be made. The device comprises an air delivery system having a throttle valve assembly 8. A butterfly throttle valve 10 located in the housing of the assembly is controlled by the driver and is provided with a sensor 12 delivering an electrical output signal which represents the degree of opening of the throttle valve. As shown, the throttle valve assembly 8 is double and has two simultaneously controlled throttle valves, but that arrangement is given as an example only. The air delivery system of the engine comprises, downstream of the throttle valve assembly 8, an air induction pipe 14 having several branches which individually open each upstream of the inlet valve 16 of a respective combustion chamber of the engine.

An additional air line 18 provided with an electrically controlled valve 20 conveys air by-passing the throttle valve assembly 8 under certain phases of operation, particularly during start when the throttle valve 10 (or each throttle valve 10) is closed.

The throttle valve 10 is arranged for practically completely cutting off the air flow in the induction passage when in its minimum opening position, while this was not achieved or sought in most prior art devices.

A fuel feed circuit comprises an electric pump 26 which feeds injectors 34 through a filter 30 and a manifold 32. Only one injector is shown on FIG. 1. The injectors are located immediately upstream of the intake valves 16. The injectors are controlled by an electronic unit 46 which is energized by battery 48 as soon as the contact switch 50 is closed.

The electronic unit 46 fulfils several functions. It energizes the injectors 34 and it controls the additional air valve 20 responsive to input signals representative of operating parameters of the engine. As illustrated, unit 46 receives input signals representing:

- the temperature of the cooling liquid of the engine, delivered by a sensor 40,
- the air temperature at the inlet of the throttle valve assembly, delivered by a sensor 22,
- the running speed of the engine, for instance as a sequence of pulses at a variable frequency delivered by a sensor 42,
- the absolute pressure in the induction passage, delivered by a sensor 24.

The sensors for measuring the air pressure in the induction passage and the degree of opening of the throttle valve provide signals making it possible to compute the air flow rate to the engine. They may be substituted with a detector which directly measures the air flow rate.

During operation, the electronic unit 46 delivers opening pulses to each injector 34. The pulses are synchronized with opening of the respective intake valves 16. The duration of each pulse is responsive to the operating parameters.

As already indicated, each injector 34 has an air assistance chamber. In the embodiment of FIGS. 2, 3 and 4, injector 34 comprises a body 46 connected to the fuel distributor 32 and a nose 50. O-rings 52 carried by the nose bear against the the wall of a passage formed across the induction pipe and they separate the induction passage from the environment. The nose is formed with at least one fuel jet opening which can be closed by a valve member whose movements are controlled by an electromagnetic coil (not shown) located in the body and energized by unit 46.

The nose 50 of the injector is further formed with one or several outlet ports 72 for the air-fuel mixture from a mixture chamber 58 located downstream of the jet opening or openings. The mixture chamber is fed with air through a hole 56 formed in the induction pipe and opening between the two O-rings. The chamber comprises an annular semi-circular channel 60, receiving air at a mid-point thereof and a diametral channel 62 connecting the ends of the channel (FIG. 4). The hole 56 communicates with the output of the electrically controlled additional air valve via a branch 70, a distributor 68 and a line 66.

Due to that arrangement, the air flow received by the engine when the latter only receives a low air flow is almost entirely used for assisting fuel atomization. Atomization is consequently quite effective when idling or under partial load. The electronic unit 46 may be programmed for maintaining an air flow toward the air chambers of the injectors even when the throttle valve 10 is completely open, for maintaining a fresh air flow which sweeps and cools the nose of the injector.

When, as illustrated in FIG. 3, the injector is of a type which delivers two mutually diverging fuel jets, each traversing a port 72 of a transverse partition of the nose constituting a diaphragm. The two jets are typically shaped for being in the mid plane of the diametral channel 72, which passes through the axis of the injector.

The device further comprises a supplemental electrically controlled valve 74 which connects the additional air line 66 to the induction passage, downstream of throttle valve 10 and upstream of the intake manifold. The supplemental valve will typically be fully opened or fully closed, depending whether or not it receives a signal from unit 46. The supplemental valve is for delivering, to the combustion chambers of the engine, an air flow which may be additional to the maximum flow rate which follows the path comprising additional air line 66, distributor 68, branches 70 and the atomizing restrictions in the injectors. The supplemental valve 74 is closed in normal operation under partial load. It may for instance be opened under the following operating conditions, as identified by unit 46 from data derived from the sensor signals:

- cranking and cold operation of the engine at very low temperature (about −40° C. for instance);
- operation of the engine at its normal temperature, however at high speed and when operating as a brake (such condition requiring a flow rate which may need be three to four times higher than the flow rate which may pass through the atomizing restriction of the injector for avoiding damages to the catalytic converter).

It is possible to provide either or both electrically controlled valves with actuators having a progressively varying action rather than an actuator for "full or nothing" operation. Such actuators may for instance be induction motors or step-by-step motors.

I claim:

1. Fuel injection device for an internal combustion engine, comprising:

an air induction passage opening into a plurality of combustion chambers of the engine, a plurality of electrically controlled fuel injectors, each opening into said air induction passage upstream of a respective intake valve of one of said combustion chambers, each said injector having an injector body formed with means for securing said body to the induction passage and a nose formed with at least one fuel outlet passage, defining an air-fuel mixture chamber;

electronic means controlling said injectors responsive to operating parameters of the engine;

a throttle valve assembly having an operator controlled throttle valve in said induction passage, said throttle valve assembly being constructed to substantially close said induction passage upstream of said injectors when said throttle valve is in a minimum opening position;

a line connecting said induction passage upstream of said throttle assembly to said mixture chambers and having additional air valve means electrically controlled by said electronic means for air flow adjustment in said line; and a supplementary electrically controlled valve branched out of said line downstream of said additional air valve means and opening into said induction passage downstream of said throttle valve assembly, said supplementary electrically controlled valve being controlled by said electronic means for opening during cold start of the engine at low temperature and during operation of the engine as a brake at normal temperature, high speed and with the throttle valve closed.

2. Device according to claim 1, further comprising distributor means for distributing air which traversed said additional air valve means to said injectors.

3. Device according to claim 1, wherein said mixture chamber comprises a half-ring passage fed with air in a central portion thereof by said line and a diametrically located passage located to be traversed by fuel jet or jets delivered by the injector.

4. Device according to claim 3, wherein said injector has two narrow mutually diverging jets, located in a midplane of said diametral passage.

5. Device according to claim 3, wherein said injector has a plurality of jets all contained in a plane which includes the axis of a respective one of said intake valves.

6. Device according to claim 1, wherein said supplementary electrically controlled valve is sized for passing an air flow comprised between 2.5 and 4 times a maximum flow rate which can traverse the mixture chambers of said injectors.

* * * * *